United States Patent [19]

Demarest, Jr.

[11] Patent Number: 4,735,438

[45] Date of Patent: Apr. 5, 1988

[54] POCKET-SIZED PORTABLE BOOK PAGE HOLDER FOR SMALLER BOOKS

[76] Inventor: Russell G. Demarest, Jr., 60 Forest Rd., Glen Rock, N.J. 07452

[21] Appl. No.: 68,455

[22] Filed: Jul. 1, 1987

[51] Int. Cl.[4] ..... B42D 9/00

[52] U.S. Cl. ..... 281/42; 24/67.3; 24/67.5

[58] Field of Search ..... 24/67 R, 67.3, 67.7, 24/455, 511; 40/152, 158 R, 159, 611; 267/53; 281/42, 45, 2, 5; 282/11.5 R; 283/62

[56] References Cited

U.S. PATENT DOCUMENTS

| | | | |
|---|---|---|---|
| 126,901 | 5/1872 | Phelps | 24/67.5 |
| 2,176,567 | 10/1939 | Ellis | 24/67.5 |
| 2,780,481 | 2/1957 | Green | 281/42 |
| 3,286,381 | 11/1966 | Wooge | 24/67.5 |
| 4,023,721 | 5/1977 | Erthein | 24/67.5 |
| 4,332,060 | 6/1982 | Sato | 24/67.9 |
| 4,335,903 | 6/1982 | Collins et al. | 281/42 |
| 4,402,530 | 9/1983 | Daguerre | 281/45 |
| 4,532,680 | 8/1985 | Hashimoto | 24/67.3 |

*Primary Examiner*—Paul A. Bell

*Attorney, Agent, or Firm*—Samuelson & Jacob

[57] ABSTRACT

A pocket-sized, portable book page holder for use in connection with holding open a smaller book having relatively narrow pages joined together along a central binding without obscuring the text appearing on the selected spread-apart pages, the book page holder including a pair of retainers biased into close juxtaposition with a spine and movable away from the spine and from one another by the manipulation of actuating handles associated with the retainers so as to receive a portion of the book between the retainers for gripping by the retainers along marginal portions of the selected pages and to hold the book open to the selected pages, the book page holder being in a compact, folded configuration for ease of carrying when not in use.

12 Claims, 2 Drawing Sheets

POCKET-SIZED PORTABLE BOOK PAGE HOLDER FOR SMALLER BOOKS

The present invention relates generally to devices for holding a book open to a selected page and pertains, more specifically, to a book page holder which is compact and portable and which is particularly well-adapted for use with smaller books such as those commonly known as paperback books.

Despite the proliferation of other forms of media, books remain a most popular form of communication, as well as a diversion, for a very large segment of the population. Books are being read under a variety of circumstances, many of which would profit from the assistance of a device which can hold a book open to a selected page. For example, a commuter may read a book while standing and may need assistance in holding a particular page in place. A person may wish to read a book while having a meal and could use a device which holds the book open to a selected page without the use of two hands on the book. Very often, the books read under the circumstances outlined above are compact books such as those known as paperback books. While many book holders have been devised in the past for accomplishing the desired selected retention of a book page, there is a present need for a more compact, easy-to-carry book page holder which is especially suited for use in connection with smaller books, such as paperback books, read under the above-outlined circumstances.

Accordingly, the present invention provides a book page holder which exhibits several objects and advantages, some of which may be summarized as: An exceptionally compact structure which is capable of being carried easily in a confined space and is put into operation effectively without difficulty; ease of use in connection with compact books, such as paperback books, without obscuring the text of the book; versatility in accommodating books of varying thicknesses without loss of effectiveness; simplicity of construction for economy of manufacture and ease of use; and rugged construction for reliable service over a long service life.

The above objects, as well as further objects and advantages, are attained by the present invention which may be described briefly as a pocket-sized portable book page holder for use in connection with holding open a smaller book having relatively narrow pages joined together along a central binding, the book page holder comprising: a spine extending longitudinally between opposite ends and having a lateral width; a pair of retainers located one adjacent each of the opposite ends of the spine, each retainer having opposite ends; resilient biasing means coupling one end of each retainer with a corresponding end of the spine for movement between a first position wherein the retainer is overlapped in close juxtaposition with the spine so that the retainers extend from each of the opposite ends of the spine toward one another, generally parallel to the spine in an altitudinally compact arrangement in which the other ends of the retainers are juxtaposed with one another, and a second position wherein the other ends of the retainers are spaced apart from one another, the resilient biasing means biasing the retainers toward the first position; a gripping surface extending laterally ajacent said other end of each retainer; an actuating handle associated with each retainer; and pivotal means coupling each actuating handle with a corresponding retainer adjacent the other end of each retainer such that the actuating handles are movable selectively between a first position wherein each actuating handle extends longitudinally along a corresponding retainer with the actuating handles projecting longitudinally outwardly from said other ends of the retainers in opposite longitudinal directions, and a second position wherein each actuating handle projects essentially longitudinally from a corresponding other end of the retainer in the same longitudinal directions; whereby, upon placement of the actuating handles in the first position thereof, when the retainers are the first position, the actuating handles may be actuated to move the retainers toward the second position thereof, against the bias of the biasing means, for insertion of a portion of the book adjacent the central binding of the open book between the gripping surfaces of the retainers, and then released to enable the gripping surfaces to grip the open book along the inserted portion so as to hold the book open, the released actuating handles being movable subsequently to the second position thereof to extend along the book adjacent the central binding of the gripped open book.

The invention will be understood more fully, while still further objects and advantages will become apparent, in the following detailed description of a preferred embodiment of the invention illustrated in the accompanying drawing, in which.

Figure 1:
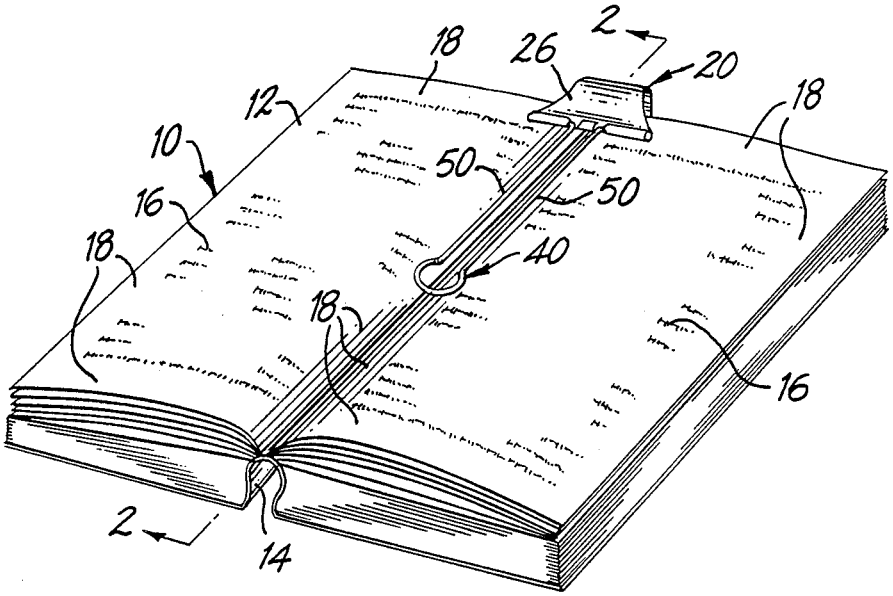
FIG. 1 is a perspective view of a book to which there has been affixed a book page holder constructed in accordance with the present invention.
Figure 2:
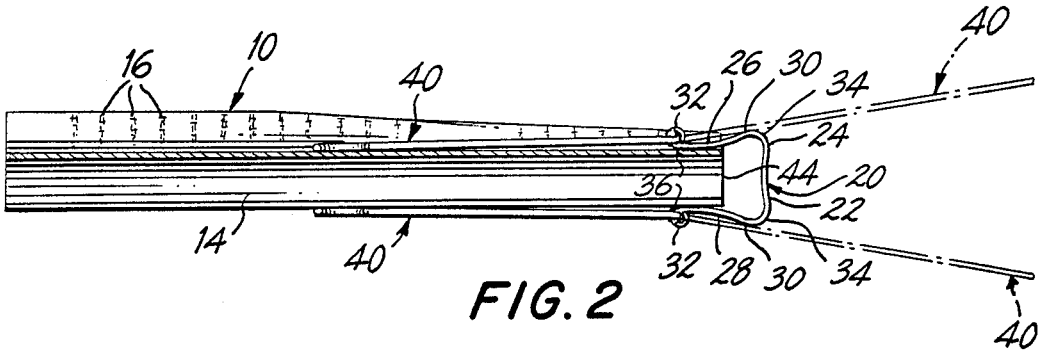
FIG. 2 is a cross-sectional view taken along line 2—2 of FIG. 1.

Referring now to the drawing, and especially to FIG. 1 thereof, a book 10 is shown having a plurality of pages 12 bound together along the central binding 14 of the book 10 and including printed text 16 placed within margins 18. The book is open to selected pages 12 from which text 16 is to be read. In order to assist in holding the pages 12 in place for reading, a book page holder 20, constructed in accordance with the invention, has been affixed to the book 10. As seen in FIG. 2, as well as in FIG. 1, book page holder 20 has a spine 22 which extends longitudinally between opposite ends 24. A pair of retainers 26 and 28 are located one adjacent each of the opposite ends 24, each of the retainers 26 and 28 themselves having opposite ends 30 and 32. End 30 of each retainer 26 and 28 is coupled to a corresponding end 24 of the spine 22 by a resilient biasing means shown in the form of U-shaped spring portion 34 which biases the retainers 26 and 28 inwardly toward the spine 22, in a manner which will be explained in greater detail below. Suffice it to say at this juncture that the biasing force upon the retainers 26 and 28 urges confronting gripping surfaces 36, which are located adjacent the opposite end 32 of each retainer 26 and 28, toward one another to grip the book 10 adjacent the central binding 14 thereof and hold the pages 12 spread apart for display of the text 16 for reading. It is noted that the length of at least retainer 26, between the ends 30 and 32, is limited so that retainer 26 is situated within the upper margin 18, above the text 16, so as not to obscure or conceal any portion of the text 16.

An actuating handle 40 is coupled to each retainer 26 and 28 at the end 32 thereof by pivotal means which enables the actuating handles 40 to be rotated relative to each retainer 26 and 28 so that the actuating handles 40 may be placed in any one of several operating positions. In FIGS. 1 and 2, the actuating handles 40 are shown projecting in a generally longitudinal direction, almost as an extension of the corresponding retainers 26 and 28, so as to rest adjacent the central binding 14 of the book 10, within the inner margins 18, thereby assuring that viewing of the text 16 remains unobstructed. In FIGS. 3 through 8 the actuating handles 40 are shown in other operating positions for purposes which now will be described.

Figure 3:
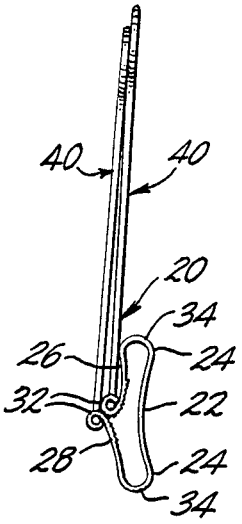
FIG. 3 is a side elevational view of the book page holder in a folded configuration for carrying.

Looking first at FIG. 3, book page holder 20 is seen in a fully-folded, or collapsed configuration in which the book page holder 20 is compact and best suited for carrying. In this compact configuration, the actuating handles 40 project in a generally longitudinal direction and both actuating handles 40 extend in the same longitudinal direction to be juxtaposed with one another, as well as with the spine 22 and retainers 26 and 28, so that the entire construction is relatively flat. The ends 32 of the retainers 26 and 28 are staggered somewhat in the altitudinal direction, that is, in the direction generally normal to the longitudinal extent of the spine 22 and the retainers 26 and 28, to permit the close juxtaposition of the actuating handles 40 with the remainder of the structure. The spine 22, retainers 26 and 28, and the coupling U-shaped spring portion 34 preferably are constructed of a unitary strip of spring material, such as spring steel. The U-shaped spring portion 34 biases the retainers 26 and 28 into overlapping, close juxtaposition with the spine 22 so as to maintain the book page holder 20 in the illustrated exceptionally compact configuration, enabling ease of carrying in a pocket or purse.

Figure 4:
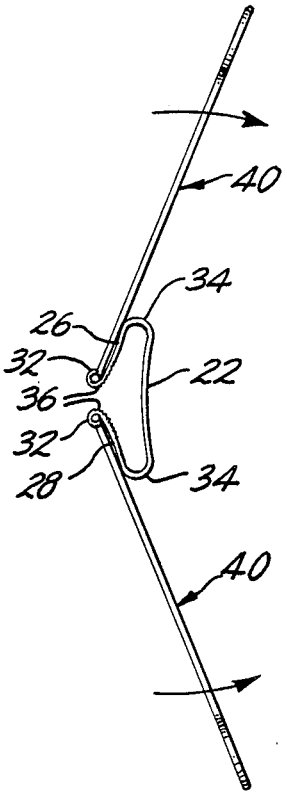
FIG. 4 is a side elevational view similar to FIG. 3, but with the component parts in another position.
Figure 5:
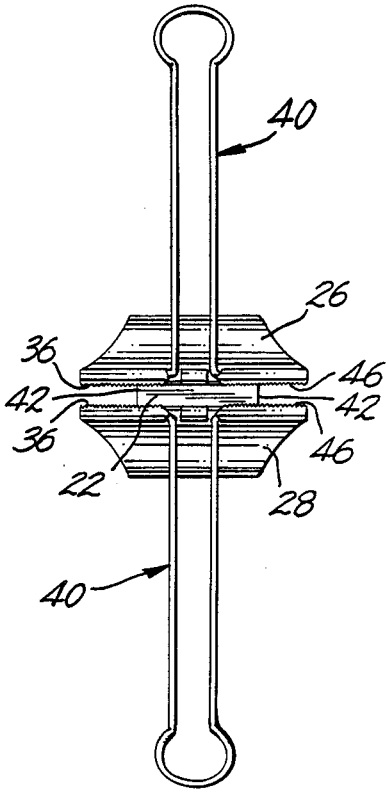
FIG. 5 is a front elevational view of the book page holder with the component parts in the position shown in FIG. 4.
Figure 6:
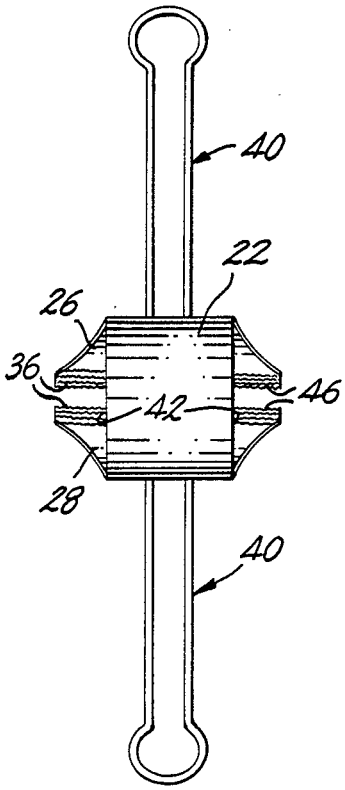
FIG. 6 is a rear elevational view of the book page holder as illustrated in FIG. 4.
Figure 7:
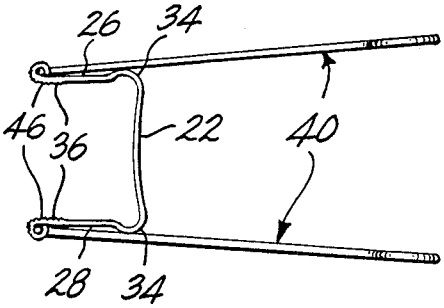
FIG. 7 is a side elevational view of the book page holder with the component parts in another position.
Figure 8:
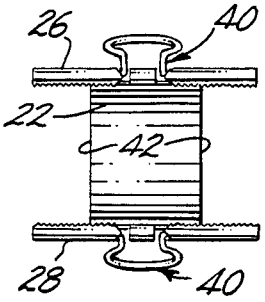
FIG. 8 is a front elevational view of the book page holder with the component parts in the position shown in FIG. 7.

Turning now to FIGS. 4 through 6, when the book page holder 20 is to be put into service, the actuating handles 40 are rotated in opposite directions so as to spread apart the retainers 26 and 28. As seen in FIGS. 5 and 6, spine 22 and the U-shaped spring portions 34 preferably are made narrower between the lateral edges 42 thereof as compared with the lateral width of the retainers 26 and 28, especially at the ends 32 thereof, so that the retainers 26 and 28 may be moved apart without excessive resistance. Further such movement of the actuating handles 40 will open the book page holder 20 more fully, as illustrated in FIGS. 7 and 8, to the point where the upper edge portion 44 of book 10 can be admitted into the book page holder 10, between the opposed gripping surfaces 36 of the retainers 26 and 28. Release of the actuating handles 40 then will enable the U-shaped spring portions 34 to bias the retainers 26 and 28, and the gripping surfaces 36 thereof, into gripping engagement with the book 10, at the selected pages 12, to secure the book page holder 20 on the book 10 and hold the selected pages 12 in place, as seen in FIG. 2. The gripping engagement is enhanced by providing a friction-increasing surface treatment, such as serrations 46, along the gripping surfaces 36. The actuating handles 40 may then be rotated from the position shown in phantom in FIG. 2 to the full-line position illustrated in FIGS. 1 and 2. Book page holder 20 is releaed from book 10 merely by reversing the above procedure; that is, the actuating handles 40 are moved from the full-line position illustrated in FIG. 2 to the position shown in phantom, and then to the positions shown in FIGS. 7 and 8, and ultimately moved to assume the positions shown in FIG. 3.

Figure 9:
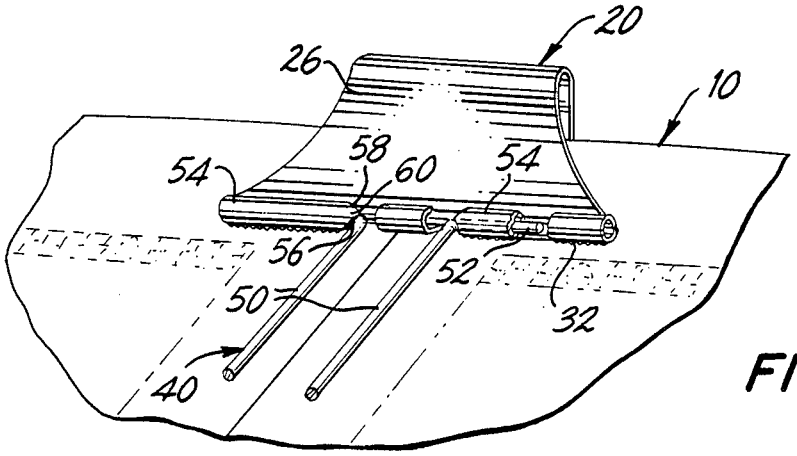
FIG. 9 is an enlarged fragmentary view of a portion of the book page holder as illustrated in FIG. 1.

Turning now to FIG. 9, resilient detent means are provided to releasably secure each of the actuating handles 40 in the positions shown in FIG. 1 and in FIG. 3. Thus, each handle 40 includes a pair of arms 50 each having a finger 52 journaled for rotation within a sleeve 54 extending along the end 32 of a corresponding retainer 26 and 28. Each sleeve 54 includes a first detent slot 56, a second detent slot 58, and a detent projection 60 between the detent slots 56 and 58. The arms 50 are biased resiliently outwardly away from one another to enter one or the other of the detent slots 56 and 58 for releasably securing the arms 50, and the actuating handles 40, in either one of the two positions defined by the slots 56 and 58. Upon forced rotation of the actuating handles 40 from one of those positons to the other, the arms 50 will move toward one another as the arms 50 ride over the detent projection 60 and will be releasably secured within either slot 56 or 58 by the detent projection 60. When the lower one of the actuating handles 40 is secured in the position shown in phantom in FIG. 2, the angled orientation of that lower actuating handle 40 enables the lower actuating handle 40 to serve as a prop for supporting the book 10 upon a table top or a like surface at an appropriate angle for reading.

Thus, the present invention provides a book page holder which is compact and easy to carry and is put into service readily for use with books of varying size and thickness, and is especially well-suited for use in connection with smaller books, having narrow pages, such as the popular, portable paperback books which are so prevalent today.

It is to be understood that the above detailed description of a preferred embodiment of the invention is provided by way of example only. Various details of design and construction may be modified without departing from the true spirit and scope of the invention as set forth in the appended claims.

The embodiment of the invention in which an exclusive property or privilege is claimed are defined as follows:

1. A pocket-sized portable book page holder for use in connection with holding open a smaller book having relatively narrow pages joined together along a central binding, the book page holder comprising:

a spine extending longitudinally between opposite ends and having a lateral width;

a pair of retainers located one adjacent each of the opposite ends of the spine, each retainer having opposite ends;

resilient biasing means coupling one end of each retainer with a corresponding end of the spine for movement between a first position wherein each retainer is overlapped in close juxtaposition with the spine so that the retainers extend from each of the opposite ends of the spine toward one another, generally parallel to the spine in an altitudinally compact relatively flat arrangement in which the other ends of the retainers are juxtaposed with one another, and a second position wherein the other ends of the retainers are spaced apart from one another, the resilient biasing means biasing the retainers toward the first position;

a gripping surface extending laterally adjacent said other end of each retainer;

an acutating handle associated with each retainer; and pivotal means coupling each actuating handle with a corresponding retainer adjacent the other end of each retainer such that the actuating handles are movable selectively between a first position wherein each actuating handle extends longitudinally along a corresponding retainer with the actuating handles projecting longitudinally outwardly from said other ends of the retainers in opposite longitudinal directions, and a second position wherein each actuating handle projects essentially longitudinally from a corresponding other end of the retainer in the same longitudinal direction;

whereby, upon placement of the actuating handles in the first position thereof, when the retainers are in the first position, the actuating handles may be actuated to move the retainers toward the second position thereof, against the bias of the biasing means, for insertion of a portion of the book adjacent the central binding of the open book between the gripping surfaces of the retainers, and then released to enable the gripping surfaces to grip the open book along the inserted portion so as to hold the book open, the released actuating handles being movable subsequently to the second position thereof to extend along the book adjacent the central binding of the gripped open book.

2. The invention of claim 1 including resilient detent means for releasably securing the actuating handles in either one of the first and second positions thereof.

3. The invention of claim 1 wherein the opposite ends of the retainers are staggered altitudinally when the retainers are in the first position thereof such that one actuating handle may be placed at the second position thereof while the other actuating handle is placed at the first position thereof, whereby the actuating handles are folded to extend in the same longitudinal direction, generally parallel to the retainers and the spine, in a compact, folded configuration for convenient carrying.

4. The invention of claim 1 wherein the lateral width of the spine is less than the corresponding lateral extent of the retainers at the gripping surfaces.

5. The invention of claim 4 wherein the gripping surfaces include a friction-increasing surface treatment.

6. The invention of claim 5 wherein the surface treatment comprises serrations extending along the gripping surfaces.

7. The invention of claim 1 where the spine, the retainers and the resilient biasing means comprise a unitary structure of resilient sheet material.

8. The invention of claim 7 wherein the sheet material is spring steel.

9. The invention of claim 7 wherein the opposite ends of the retainers are staggered altitudinally when the retainers are in the first position thereof such that one actuating handle may be placed at the second position thereof while the other actuating handle is placed at the first position thereof, whereby the actuating handles are foled to extend in the same longitudinal direction, generally parallel to the retainers and the spine, in a compact, folded configuration for convenient carrying.

10. The invention of claim 9 including resilient detent means for releasably securing the actuating handles in either one of the first and second positions thereof.

11. The invention of claim 7 wherein the resilient biasing means is a U-shaped resilient portion placed between each retainer and a corresponding end of the spine.

12. The invention of claim 11 wherein the lateral width of the U-shaped resilient portion is less than the corresponding lateral extent of the retainers at the gripping surfaces.

* * * * *